US010166584B2

(12) United States Patent
Brown et al.

(10) Patent No.: US 10,166,584 B2
(45) Date of Patent: Jan. 1, 2019

(54) PROCESS DAMPING OF SELF-EXCITED THIRD OCTAVE MILL VIBRATION

(71) Applicant: NOVELIS INC., Atlanta, GA (US)

(72) Inventors: Rodger Brown, Atlanta, GA (US); Matthew Seibert, Russellville, KY (US); Donald L. Miller, Bowling Green, KY (US); Matthew Fairlie, Mulmur (CA); David Gaensbauer, Atlanta, GA (US)

(73) Assignee: Novelis Inc., Atlanta, GA (US)

( * ) Notice: Subject to any disclaimer, the term of this patent is extended or adjusted under 35 U.S.C. 154(b) by 206 days.

(21) Appl. No.: 14/800,074

(22) Filed: Jul. 15, 2015

(65) Prior Publication Data

US 2016/0016215 A1 Jan. 21, 2016

Related U.S. Application Data

(60) Provisional application No. 62/024,517, filed on Jul. 15, 2014.

(51) Int. Cl.
*B21B 37/48* (2006.01)
*B21B 38/06* (2006.01)
(Continued)

(52) U.S. Cl.
CPC ..... *B21B 37/48* (2013.01); *B21B 1/22* (2013.01); *B21B 38/06* (2013.01); *B21B 39/082* (2013.01); *B21B 2203/44* (2013.01)

(58) Field of Classification Search
CPC ..... B21B 37/46; B21B 37/48; B21B 37/007; B21B 39/02; B21B 39/08; B21B 39/082; B21B 38/06
See application file for complete search history.

(56) References Cited

U.S. PATENT DOCUMENTS 3,528,268 A * 9/1970 Roberts ..... B21B 41/00 266/113
5,046,347 A 9/1991 Crosato et al.
(Continued)

FOREIGN PATENT DOCUMENTS

AT 507088 A4 2/2010
CN 1743091 A 3/2006
(Continued)

OTHER PUBLICATIONS

EPO Machine Translation to JP 07096308 A, Nov. 2017.*
(Continued)

*Primary Examiner* — Pradeep C Battula
(74) *Attorney, Agent, or Firm* — Kilpatrick Townsend & Stockton LLP

(57) ABSTRACT

Control of self-excited third octave vibration in a metal rolling mill can be achieved by adjusting the tension of the metal strip as it enters a stand. Self-excited third octave vibration can be detected and/or measured by one or more sensors. A high-speed tension adjustor can rapidly adjust the entry tension of the metal strip (e.g., as the metal strip enters a mill stand) to compensate for the detected self-excited third octave vibration. High-speed tension adjustors can include any combination of hydraulic or piezoelectric actuators coupled to the center roll of a bridle roll to rapidly raise or lower the roll and thus induce rapid tension adjustments in the strip. Other high-speed tension adjustors can be used.

20 Claims, 8 Drawing Sheets

(51) Int. Cl.
*B21B 1/22* (2006.01)
*B21B 39/08* (2006.01)

(56) References Cited

U.S. PATENT DOCUMENTS

| | | | | |
|---|---|---|---|---|
| 5,142,891 | A | 9/1992 | Kuwano | |
| 5,679,900 | A | 10/1997 | Smulders | |
| 5,701,775 | A | 12/1997 | Sivilotti et al. | |
| 6,079,242 | A * | 6/2000 | Allegro | B21B 37/56 72/10.3 |
| 7,155,951 | B2 * | 1/2007 | Farley | B21B 37/007 72/205 |
| 8,302,445 | B2 | 11/2012 | Pawelski et al. | |
| 8,695,391 | B2 * | 4/2014 | Keintzel | B21B 37/007 72/245 |
| 9,156,070 | B2 * | 10/2015 | Kaga | B21B 37/46 |
| 2008/0243274 | A1 | 10/2008 | Keintzel et al. | |
| 2010/0161104 | A1 | 6/2010 | Lofgren et al. | |
| 2012/0000543 | A1 * | 1/2012 | Keintzel | F15B 21/008 137/12 |
| 2012/0235331 | A1 | 9/2012 | Lemay et al. | |
| 2013/0192324 | A1 | 8/2013 | Vignolo et al. | |

FOREIGN PATENT DOCUMENTS

| | | | | |
|---|---|---|---|---|
| CN | 203370829 | U | 1/2014 | |
| CN | 103717322 | A | 9/2016 | |
| DE | 10254958 | A1 | 6/2004 | |
| EP | 1457274 | A2 | 9/2004 | |
| EP | 2052796 | B1 | 8/2011 | |
| JP | 54067548 | A * | 5/1979 | B21B 39/08 |
| JP | 59183924 | U | 10/1984 | |
| JP | S63101013 | A | 5/1988 | |
| JP | 04182019 | A | 6/1992 | |
| JP | H05212410 | A | 8/1993 | |
| JP | 07096308 | A * | 4/1995 | B21B 37/007 |
| JP | H08238510 | A | 9/1996 | |
| JP | H08238511 | A | 9/1996 | |
| JP | H08238512 | A | 9/1996 | |
| JP | H10314816 | A | 12/1998 | |
| JP | 2006130546 | A | 5/2006 | |
| JP | WO 2008062506 | A1 * | 5/2008 | B21B 37/46 |
| JP | 2010094705 | A | 4/2010 | |
| JP | 2013010110 | A | 1/2013 | |
| JP | 2014113629 | A | 6/2014 | |
| KR | 1020110097927 | A | 8/2011 | |
| WO | 9627454 | A1 | 9/1996 | |
| WO | 9727953 | A1 | 8/1997 | |
| WO | 0023204 | A1 | 4/2000 | |
| WO | 0249782 | A1 | 6/2002 | |
| WO | WO 2009153101 | A1 * | 12/2009 | B21B 37/007 |
| WO | 2012046211 | A1 | 4/2012 | |

OTHER PUBLICATIONS

Farley, Tom, "Mill vibration during cold rolling", 8 pages, Innoval Technology Limited, United Kingdom.
Farley, Tom, "Rolling Mill Vibration and its Impact on Productivity and Product Quality", 7 pages, Innoval Technology Limited, United Kingdom.
"Vibration in Rolling Mills", Conference Papers, Nov. 9, 2006, 58 pages, IOM Communications Ltd, United Kingdom.
"Active Chatter Damping System", May 2013, 16 pages, Siemens VAI.
International Patent Application No. PCT/US2015/040561, International Search Report and Written Opinion dated Sep. 28, 2015, 11 pages.
International Patent Application No. PCT/US2015/040588, International Search Report and Written Opinion dated Oct. 1, 2015, 11 pages.
International Patent Application No. PCT/US2015/040561, International Preliminary Report on Patentability dated Jan. 26, 2017, 7 pages.
International Patent Application No. PCT/US2015/040588, International Preliminary Report on Patentability dated Feb. 9, 2017, 8 pages.
Korean Patent Application No. KR 10-2017-7004142, Office Action dated Jan. 4, 2018, 17 pages.
Japanese Patent Application No. JP 2017-501715, Office Action dated Jan. 9, 2018, 18 pages.
Chinese Patent Application No. CN 201580038235.2, Office Action dated Jan. 17, 2018, 36 pages.
Canadian Patent Application No. 2,954,513, Office Action dated Nov. 29, 2017, 3 pages.
Japanese Pat. Appl. No. 2017-501715, Office Action dated Aug. 21, 2018, 11 pages.
Suzuki, "Story of Rolling (74), Study of Machine", May 1996, pp. 583-588, vol. 48, No. 5, Yokendo Ltd., Japan.
Suzuki, "Story of Rolling (75), Study of Machine", Jun. 1996, pp. 705-710, vol. 48, No. 6, Yokendo Ltd., Japan.

* cited by examiner

PROCESS DAMPING OF SELF-EXCITED THIRD OCTAVE MILL VIBRATION

CROSS REFERENCE TO RELATED APPLICATION

The present application claims the benefit of U.S. Provisional Patent Application No. 62/024,517 filed on Jul. 15, 2014, entitled "PROCESS DAMPING OF SELF EXCITED THIRD OCTAVE MILL VIBRATION," which is hereby incorporated by reference in its entirety.

TECHNICAL FIELD

The present disclosure relates to metalworking generally and more specifically to controlling vibrations in high-speed rolling mills.

BACKGROUND

Metal rolling, such as high-speed rolling, is a metalworking process used for producing metal strip. Resulting metal strip can be coiled, cut, machined, pressed, or otherwise formed into further products, such as beverage cans, automotive parts, or many other metal products. Metal rolling involves passing metal (e.g., a metal strip) through one or more mill stands, each having one or more work rolls that compress the metal strip to reduce the thickness of the metal strip. Each work roll can be supported by a backup roll.

During metal rolling, such as high-speed metal rolling, self-excited vibrations can occur on resonant frequencies of the mill. Specifically, each mill stand can vibrate in its own self-excited vibration. Self-excited vibration can be very prevalent in or around the range of approximately 100 Hz to approximately 300 Hz. This type of self-excited vibration can be known as "Third Octave" vibration because the frequency band of the mill's vibration coincides with the third musical octave (128 Hz to 256 Hz). This self-excited third octave vibration is self-sustaining vibration produced by the interaction between the rolls' spreading forces and the entry strip tension (e.g., tension of the strip in the direction of rolling as the strip enters the mill stand). Self-excited third octave vibration does not require energy to be delivered at the resonant frequency in order to excite the mill stand's natural resonance.

Self-excited third octave vibration can cause various problems in a mill. If left unchecked, self-excited third octave vibration can damage the mill stand itself, including the rolls, as well as damage any metal being rolled, rendering the metal unusable, and therefore scrap. Attempts have been made to counter self-excited third octave vibration by slowing the rolling speed the moment self-excited third octave vibration is detected. Such approaches can still cause wear to the mill stand and damage to the metal strip being rolled in small amounts, and can significantly slow the process of rolling the metal strip, reducing possible output of the mill.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

Aspects of the present disclosure are related to a method of controlling self-excited third octave vibrations within rolling mills. Some aspects of the present disclosure comprise a two (or more) stand tandem cold mill comprising between stands a tension adjustment device selected from the group consisting of a center bridle roll, an actuated deflection roll, a hydrofoil deflector, or an actuated sheet wiper, and a control system designed to vary vertical placement of the tension adjustment device in response to inter-stand strip tension disturbances occurring at a frequency of approximately 90-300 hertz. In other cases, the present concepts comprise a single stand mill comprising an uncoiler positioned upstream of the mill stand, a tension adjustment device selected from the group consisting of a center bridle roll, an actuated deflection roll, or an actuated sheet wiper, and a control system designed to vary vertical placement of the tension adjustment device in response to tension disturbances between the uncoiler and the mill stand.

In some cases, the control system comprises at least two hydraulic cylinders located proximate each end of the tension adjustment device, and a controller having a position control loop and a fast tension loop, wherein the fast tension loop is configured to vary vertical placement of the tension adjustment device in response to tension disturbances occurring at the frequency of third octave mill stand resonance typically in the range of approximately 90-150 hertz, and the position control loop is configured to maintain the vertical placement of the tension adjustment device in response to tension disturbances occurring at lower frequencies.

In other cases, the control system comprises at least two hydraulic cylinders located proximate each end of the tension adjustment device, a plurality of piezoelectric actuators positioned between each of the at least two hydraulic cylinders and the tension adjustment device, and a controller having a position control loop and a separate controller, wherein the separate controller is configured to vary vertical placement of the tension adjustment device in response to tension disturbances occurring at the frequency of third octave mill stand resonance typically in the range of approximately 90-300 hertz, and the position control loop is configured to maintain the vertical placement of the tension adjustment device in response to tension disturbances occurring at lower frequencies. The frequency of the third octave mill stand resonance may further be in the range of approximately 90-200 hertz.

In certain cases, the control system comprises at least two piezoelectric stacks located proximate each end of the tension adjustment device, and a controller having a strip tension control loop configured to vary vertical placement of the tension adjustment device in response to tension disturbances occurring at the frequency of third octave mill stand resonance typically in the range of approximately 90-300 hertz. The frequency of the third octave mill stand resonance may further be in the range of approximately 90-200 hertz.

In some cases, the control system comprises at least two piezoelectric stacks, each piezoelectric stack being located on an upper surface of an adjustable end stop on each side of a center frame supporting the tension adjustment device, and a controller having a strip tension control loop configured to vary vertical placement of the tension adjustment device in response to tension disturbances occurring at the frequency of third octave mill stand resonance typically in the range of approximately 90-300 hertz. The frequency of the third octave mill stand resonance may further be in the range of approximately 90-200 hertz.

The aspects of the present disclosure can be applied to correct self-excited third octave vibration in tandem mills having more than two stands and in a single stand mill having a tension zone between another piece of equipment, such as an uncoiler, and the mill stand and that, depending on the mill configuration, the bridle roll assembly could be replaced by a single actuated deflection roll or similar device such as sheet wiper acting the same way to adjust the tension in the sheet entering the mill. Furthermore, the same concepts could be applied to correct other tension disturbances occurring at frequencies outside of the Third Octave Mill Vibration frequency range.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
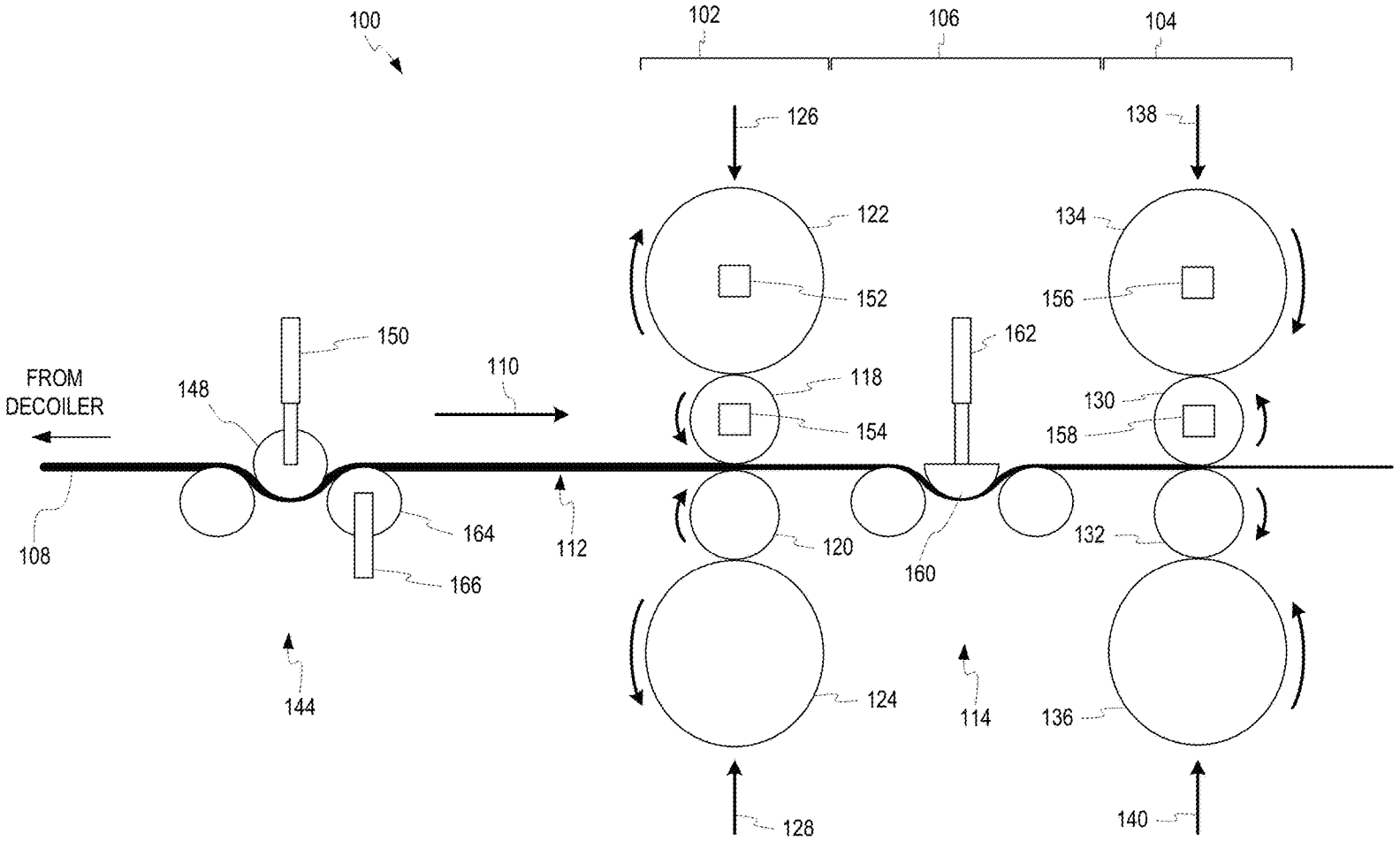
FIG. 1 is a schematic side view of a four-high, two-stand tandem rolling mill according to certain aspects of the present disclosure.

The subject matter of embodiments of the present disclosure is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Certain aspects and features of the present disclosure relate to controlling self-excited third octave vibration in a metal rolling mill by making adjustments to the tension of the metal strip as it enters a stand. Self-excited third octave vibration can be detected and/or measured by one or more sensors. A high-speed tension adjustor can rapidly adjust the entry tension of the metal strip (e.g., as the metal strip enters a mill stand) to compensate for the detected self-excited third octave vibration. High-speed tension adjustors can include any combination of hydraulic or piezoelectric actuators coupled to the center roll of a bridle roll to rapidly raise or lower the roll and thus induce rapid tension adjustments in the strip. Other high-speed tension adjustors can be used.

Various aspects and features of the present disclosure can be used to control self-excited third octave vibration. Self-excited third octave vibration can include self-excited vibrations at or around 90-300 hertz. The various aspects and features of the present disclosure can be used to control self-excited third octave vibration in the range of approximately 90-200 Hz, 90-150 Hz, or any suitable ranges within the aforementioned ranges. The various aspects and features of the present disclosure can also be used to control tension disturbances at other frequencies.

Self-excited third octave vibration can occur on any rolling mill where the tension of the incoming strip to the roll gap is not precisely controlled and the strip speed is sufficiently high (e.g., sufficiently fast rolling speed). The concepts disclosed herein relate to control of strip tension as the strip enters a mill stand. As such, the concepts disclosed herein can be applied to a metal strip entering a mill stand from another piece of equipment, such as a decoiler. In addition, the concepts can be applied to a metal strip traveling between mill stands of a multiple-stand mill (e.g., a two, three, or more stand tandem cold mill).

For example, a two stand tandem cold mill can include a tension zone the length of the metal strip in the inter-stand region. Tension can be created by the speed difference between the strip's entry speed into, and exit speed out of, the tension zone. The speed of the strip entering the zone may be set by the preceding stand's roll speed. The strip's speed out of the zone is determined by the downstream stand's roll speed and the roll gap of the downstream mill stand. On a two stand tandem mill, the downstream gap can be controlled to achieve the sheet thickness required.

Inter-stand tension can be controlled by adjusting the difference between the roll speeds of the two stands and by adjusting the downstream stand's roll gap. Using either of these two adjustments to control inter-stand tension at the mill's chatter frequency (e.g., the frequency for self-excited third octave vibration) can be difficult, if not impossible. Adjusting roll speeds and roll gap can require movement of large masses and can require significant amounts of energy to mitigate chatter. It can be impractical and/or economically prohibitive to mitigate self-excited third octave vibration using these adjustments.

As an example, a two stand tandem mill can be considered and modeled. In this mill, the second stand can experience self-excited third octave vibration, wherein the vertical movement of the second stack (x) as a function of the roll's separating force ($F_s$) can be described in the Laplace Domain as seen in Equation 1, below, where $K_1$ represents the spring constant that produces a separating force resulting from a change in stack movement (e.g., the mill's spring constant), $K_2$ represents the spring constant that produces and entry tension driven separating force resulting from a change in stack movement (e.g., stiffness of the inter-stand zone), s represents the Laplace operator, M represents the mass of the stack components that are moving (e.g., the top backup roll and the top work roll—the bottom work roll and the bottom backup roll can be stationary), D represents the natural damping coefficient of the stack and has a positive value, and $T_t$ represents the transit time taken for the strip to travel between stands (e.g., time to transit the inter-stand tension zone).

$$\frac{x}{F_S} = \frac{K_1(1+T_t s)}{(K_1+K_2)M(1+T_2 s)\left(s^2+\left(\frac{D}{M}-\frac{K_2}{K_1 T_t}\right)s+\frac{K_1}{M}\right)} \quad \text{Equation 1}$$

The key portion of the equation is the quadratic term in the denominator:

$$\left(s^2+\left(\frac{D}{M}-\frac{K_2}{K_1 T_t}\right)s+\frac{K_1}{M}\right).$$

This term represents the motion of a spring-mass system with damping of the form: $(s^2+2\delta\omega_n s+\omega_n^2)$. The natural frequency $\omega_n$ is determined by the system's mass and spring as $$\sqrt{\frac{K_1}{M}}$$

and the system's damping is dependent on the ratio, δ. In this case, the value of the damping ratio, δ, is related to the value of $$\left(\frac{D}{M}-\frac{K_2}{K_1 T_t}\right).$$

Therefore, the vertical movement of the stack can go into sustained oscillations (e.g., self-excited third octave vibration) when the value of damping, $$\left(\frac{D}{M}-\frac{K_2}{K_1 T_t}\right),$$

becomes negative. Therefore, it can be desirable to ensure the damping value remains positive.

The transit time variable ($T_t$) demonstrates why mill chatter can be associated with strip speed. As the mill speed rises, damping decreases and can become a negative value. Once the damping becomes negative, chatter can increase exponentially—assuming a linear system after chatter begins—until the strip breaks.

Eliminating a mill's resonant chatter frequency may not be possible or required. The mechanical structure of each mill stand determines that stand's resonant frequency. Therefore, it can be desirable to limit and/or prevent any changes to the mill's natural damping.

There are a number of possibilities for maintaining a positive level of damping as the inter-stand speed increases. Some possibilities are related to process changes that do not affect the product while others attempt to break the feedback loop between the work roll's vertical movement and inter-stand tension.

With respect to the process related options, the value of $K_2$ can be reduced in various ways. Reducing $K_2$ can be accomplished by (1) reducing the inter-stand thickness to decrease the value of $K_2$ by decreasing the impact of inter-stand tension on separating force, which can also have the effect of hardening the strip before it enters the second stand; (2) decreasing the inter-stand tension to increase the second stand's roll force, which can reduce the gain between separating force and exit thickness, further reducing the value of $K_2$; and/or (3) increasing the friction at the entry of the second stand by increasing the surface roughness and/or changing the coolant's lubricity.

Other methods for maintaining a positive level of damping as the inter-stand speed increases include increasing the value of $K_1$, such as by shortening the extension of the roll force cylinder. The cylinder's stiffness may be greatest at each end of its stroke. Depending on the arrangement, the use of shim packs may be useful. These methods also include increasing the length of the strip between stands. Increasing the length will increase the minimum transit time (increase $T_t$). Some of these solutions may be impractical or economically prohibitive to implement.

Active alternative methods to maintain positive damping include increasing the strip's elasticity as a function of frequency. If the strip appears to be very limber in the range of third octave frequencies, a change in the downstream stand's gap can produce a smaller change in tension with a corresponding smaller change in roll force. In effect, the value of $K_2$ is reduced, thereby increasing the margin of stability.

Some solutions can actively control mill vibration by measuring the mill vibration and directly changing the roll gap in anti-phase to the vibration. The performance of these systems can be highly dependent on accurate identification of the onset of third octave vibration, which may not be readily accomplished and can be inherently prone to error given the large number of different sources of mill vibration in the mill stand. These solutions also involve expensive and intrusive mechanical modifications to the mill gap regulator.

Another active alternative for maintaining positive damping comprises rejecting tension disturbances that occur as a result of a gap change. Existing active control loops employed to maintain constant strip tension have a limited frequency range and allow tension disturbances in the third octave to pass through. Aspects of the present disclosure can be used to prevent tension disturbances in the third octave range. Preventing such tension disturbances can be equivalent to forcing the value of $K_2$ to zero. By maintaining the entry tension at its target value, regardless of mill entry strip speed variations at the chatter frequency, self-excitation of the mill stack's resonant frequency by means of entry tension feedback loop can be mitigated, if not eliminated entirely.

This approach can be advantageous over controlling the rolling gap to cancel self-excited third octave vibration. For example, a controller used for such approaches can be a high frequency extension of an existing tension regulator, and so may not involve the need for process identification with its attendant errors. Also, these approaches may not involve expensive and intrusive mill modifications. For example, a high frequency tension regulator can use a lower cost actuator outside the mill stand on the entry side of the roll gap, such as a modified bridle roll assembly.

Certain aspects of the present disclosure relate to a two stand tandem cold mill comprising a center bridle roll and a control system designed to vary the vertical placement of the bridle roll in response to inter-stand strip tension disturbances occurring at a frequency of approximately 90-300 hertz, at a frequency of approximately 90-200 hertz, or at a frequency of approximately 90-150 hertz. Furthermore, the same concepts could be applied to correct other tension disturbances occurring at frequencies outside of the third octave mill vibration.

The presence of an entry bridle at the entry of a stand offers an actuator to adjust tension of the strip as it enters the stand. For example, a second stand entry bridle may be used as a high speed strip storage mechanism (e.g., can store a length of strip around the center roll of the bridle, which can be let out or taken up as necessary to maintain constant tension) that can accommodate small changes in the downstream stand's strip entry speed. Such a storage mechanism may have much less mass (e.g., less than one ton) than a backup roll (e.g., at or over 60 tons) and can require much less energy in order to control chatter. An entry bridle can be used in conjunction with other equipment or processes for maintaining tension at frequencies outside of the self-excited third octave vibrations (e.g., at low frequencies, such as under 90 hertz or under 60 hertz).

High-speed tension adjustors, such as the proposed bridle with adjustable center roller, can provide small changes in length at a very high speed (e.g., at or above 60 hertz or at or above 90 hertz). While these high-speed tension adjustors may not be able to accommodate significant changes in length, it is important that they are able to accommodate small changes in length at their high speeds. This compromise, speed versus distance, is noteworthy. At chatter frequencies, the strip storage requirements are not high, since storage is linked to the integral of velocity. In some cases, other high-speed tension adjustors can be used, such as hold down rolls, wiper blades, hydroplanes, magnetic tension adjustors. For example, a magnetic tension adjustor can include a rapidly rotating array of permanent magnets with the magnets aligned such that they impart a force at the frequency of third octave chatter, and in the direction to reduce the amplitude of the tension variation. For example, a 900 rpm rotor with eight axial rows of magnets could generate tension pulses at 120 Hz.

The high-speed tension adjustors can be controlled by controllers. The controllers can be any suitable processor or system that can accept input from a sensor and determine the adjustments necessary for the high-speed tension adjustors. Any suitable sensor that can detect the onset of self-excited third octave vibration may be used. Example sensors include one or more sensor rolls (e.g., rolls with force transducers included therein or coupled thereto), stand-mounted sensors (e.g., accelerometers), or work roll or backup roll-mounted sensors (e.g., accelerometers). Other sensors can be used. The vibrations detected at the sensor can be used by the controller to determine the necessary adjustment for the high-speed tension adjustors such that the self-excited third octave vibration is canceled-out, reduced, stopped, or prevented.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale.

FIG. 1 is a schematic side view of a four-high, two-stand tandem rolling mill 100 according to certain aspects of the present disclosure. The mill 100 includes a first stand 102 and a second stand 104 separated by an inter-stand space 106. A strip 108 passes through the first stand 102, inter-stand space 106, and second stand 104 in direction 110. The strip 108 can be a metal strip, such as an aluminum strip. As the strip 108 passes through the first stand 102, the first stand 102 rolls the strip 108 to a smaller thickness. As the strip 108 passes through the second stand 104, the second stand 104 rolls the strip 108 to an even smaller thickness. The pre-roll portion 112 is the portion of the strip 108 that has not yet passed through the first stand 102. The inter-roll portion 114 is the portion of the strip 108 that has passed through the first stand 102, but not yet passed through the second stand 104. The pre-roll portion 112 is thicker than the inter-roll portion 114, which is thicker than a post-roll portion (e.g., portion of the strip after passing the second stand 104).

The first stand 102 of a four-high stand can include opposing work rolls 118, 120 through which the strip 108 passes. Force 126, 128 can be applied to respective work rolls 118, 120, in a direction towards the strip 108, by backup rolls 122, 124, respectively. Force 126, 128 can be controlled by gauge controller. Force 138, 140 is applied to respective work rolls 130, 132, in a direction towards the strip 108, by backup rolls 134, 136, respectively. Force 138, 140 can be controlled by gauge controller. The backup rolls provide rigid support to the work rolls. In some cases, force can be applied directly to a work roll, rather than through a backup roll. In some cases, other numbers of rolls, such as work rolls and/or backup rolls, can be used. In some cases, more or fewer than two stands can be used.

The mill 100 in FIG. 1 depicts multiple mechanisms for controlling self-excited third octave vibrations, including a bridle roll 144 based mechanism to control self-excited third octave vibrations in the first stand 102 and a hydroplane 160 based mechanism to control self-excited third octave vibrations in the second stand 104. Any number or combination of mechanisms for controlling self-excited third octave vibrations can be used.

As seen in FIG. 1, the strip 108 can pass through a bridle 144 prior to entering the first stand 102. In some cases, the strip 108 can be decoiled at a decoiler prior to passing through the bridle 144. The bridle 144 can help maintain tension by adjusting the tension of the strip 108 in response to fluctuations in strip tension. The bridle 144 can include a center roller 148 that is coupled to a high-speed linear actuator 150. The high-speed linear actuator 150 can be any suitable high-speed actuator, such as those as described herein, capable of manipulating the center roller 148 at speeds sufficient to control self-excited third octave vibrations. The high-speed linear actuator 150 can directly manipulate the center roller 148 (e.g., two high-speed linear actuators can manipulate the center roller 148 at each end of the center roller) or the high-speed linear actuator 150 can indirectly manipulate the center roller 148 by manipulating a yolk supporting the center roller 148. Any number of high-speed linear actuators 150 can be used.

As third-octave vibration is detected by a sensor (e.g., a work roll-mounted sensor 154 or a backup roll-mounted sensor 152, or another sensor), a controller can cause the high-speed actuator 150 to make adjustments to the center roller 148 to compensate for high-speed (e.g., in the third octave vibration range) increases or decreases in strip tension due to third octave vibration in the first stand 102. These adjustments can keep the strip tension in the pre-roll portion 112 relatively constant, at least in the third octave vibration range, to mitigate self-excited third octave vibrations.

In addition or alternatively, a hydrofoil 160 can help maintain tension by adjusting the tension of the strip 108 in response to fluctuations in strip tension. The hydrofoil 160 can be semi-circular in shape or take on other shapes. A hydrofoil 160 maintains a barrier of lubrication (e.g., with water or lubricant) between the hydrofoil 160 and the strip 108, allowing the hydrofoil 160 to exert force on the strip 108 without the hydrofoil 160 rotating. Since the hydrofoil 160 does not need to rotate, it can be manufactured with minimal material and minimal mass. For example, a hydrofoil 160 can have a semi-circular shape or semi-ovoid shape, rather than a fully circular shape of a roll. The hydrofoil 160 can be coupled to one or more high-speed linear actuators 162, such as similarly as a center roll of a bridle is coupled to one or more high-speed linear actuators (e.g., directly or via a yolk). The unique shape of the hydrofoil 160 can allow for one or more high-speed linear actuators 162 to be coupled in other ways, such as anywhere along the width of the hydrofoil 160 (e.g., as opposed to just at the ends).

As third-octave vibration is detected by a sensor (e.g., a work roll-mounted sensor 158 or a backup roll-mounted sensor 156, or another sensor), a controller can cause the high-speed actuator 162 to make adjustments to the hydrofoil 160 to compensate for high-speed (e.g., in the third octave vibration range) increases or decreases in strip tension due to third octave vibration in the second stand 104. These adjustments can keep the strip tension in the inter-roll portion 114 relatively constant, at least in the third octave vibration range, to mitigate self-excited third octave vibrations.

In some alternate cases, the roll gap of the first stand 102 can be used to control tension in the inter-roll portion 114 in response to third-octave vibration detected by a sensor associated with the second stand 104 (e.g., sensors 156, 158). In such cases, the rolls of the first stand 102 would not need to be moved to correct vibrations in the first stand 102, but rather the rolls would be adjusted to maintain constant tension between the first stand 102 and the second stand 104.

FIG. 1 depicts sensors 152, 154 and sensor 156, 158 on the upper work rolls and backup rolls of the first stand 102 and second stand 104, respectively. However, sensors can be positioned on the bottom work rolls, bottom backup rolls, on the stand itself, or external to the stand. For example, a sensor can be positioned between the bridle 144 and the first stand 102. Such a sensor can be a sensor roll (e.g., a roll supported by a pair of force transducers to measure high-speed changes in strip tension). In some cases, other sensors can be used, such as ultrasonic, laser, or other sensors capable of detecting third octave vibration.

In some cases, the third roller 164 of the bridle 144 can act as a sensor. The third roller 164 can include internal force sensors. In some cases, the third roller 164 can be coupled to one or more load cells 166. For example, a pair of load cells 166 can be placed on opposite ends of the third roller 164. The load cells 166 can detect tension fluctuation in the third octave range.

Figure 2:
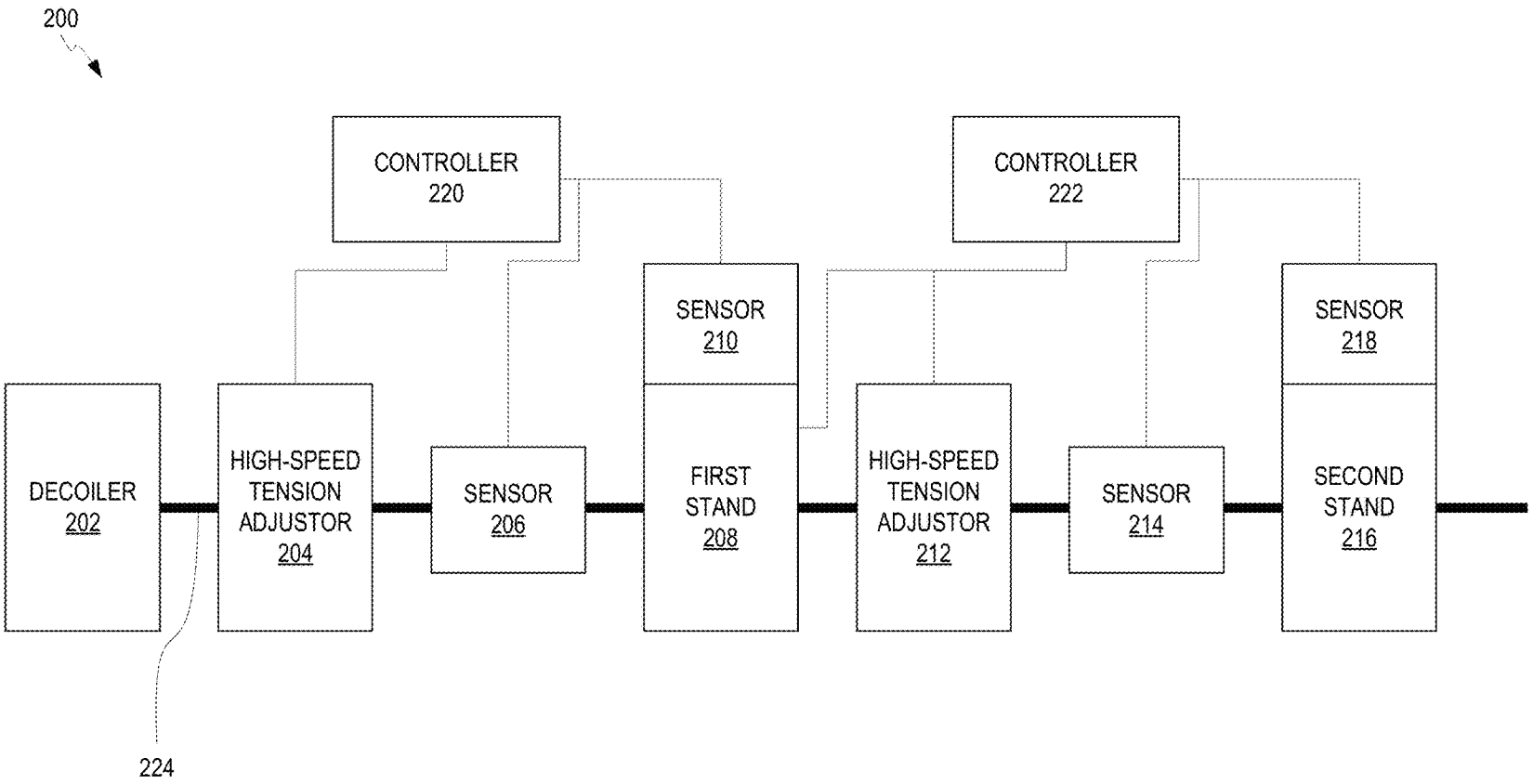
FIG. 2 is a schematic diagram depicting a mill having multiple high-speed tension adjustors for controlling third octave vibrations according to certain aspects of the present disclosure.

FIG. 2 is a schematic diagram depicting a mill 200 having multiple high-speed tension adjustors 204, 212 for controlling third octave vibrations according to certain aspects of the present disclosure. A metal strip 224 can pass through various parts from left to right, as seen in FIG. 2. Items to the left can be considered proximal to or upstream of items further to the right. For example, first stand 208 can be considered proximal to or upstream of the second stand 216.

The metal strip 224 can be decoiled at a decoiler 202. The metal strip 224 can pass through a first stand 208 and a second stand 216. While two stands are shown in FIG. 2, any number of stands, including one stand or more than two stands, can be used. The adjustments made between the first stand 208 and the second stand 216 can be used between any two stands of a multi-stand mill (e.g., between a second and third stand). The adjustments made between the decoiler 202 and the first stand 208 can be used on a single-stand mill.

As the metal strip 224 moves from the decoiler 202 to the first stand 208, it can pass through a high-speed tension adjustor 204. The high-speed tension adjustor 204 can be any adjustor as described herein, including a bridle with movable center roller, a hydrofoil, a wiper, or a magnetic system. Other high-speed tension adjustors can be used. The high-speed tension adjustor 204 can receive adjustment signals from a controller 220 based on vibrations detected in the strip 224 between the high-speed tension adjustor 204 and the first stand 208 or at the first stand 208. The controller 220 can receive signals from a sensor, such as sensor 206 or sensor 210. Sensor 206 can be a sensor placed inline between the high-speed tension adjustor 204 and the first stand 208. Sensor 206 can be any suitable sensor, such as but not limited to a deflection roll (e.g., flatness roll) coupled to one or more load cells. Sensor 210 can be a sensor, such as but not limited to an accelerometer, coupled to the first stand 208, such as on a work roll, backup roll, roll chock, or stand itself. When sensor 210 is an accelerometer, it can be tuned to only detect vertical motion of the rolls. In some cases, sensor 210 can include multiple sensors (e.g., positioned on the top and bottom work rolls) configured to detect vertical motion of the top work roll with respect to the bottom work roll. Other sensors can be used.

Upon receiving signals indicative of third octave vibrations, the controller 220 can induce high-speed tension adjustment using the high-speed tension adjustor 204. The tension adjustments can be calculated to offset or cancel out the detected or expected vibration in the first stand 208. In some cases, random tension adjustments can be induced.

In some cases, a controller 220 can be a processor or any type of digital and/or analog circuitry. In some cases, a controller 220 can be a collection of hydraulic conduits, chambers, and actuators designed to function as described herein.

The high-speed tension adjustor 204 can reject high frequency (e.g., third octave) strip tension disturbances. The high-speed tension adjustor 204 therefore must be able to move at a rate fast enough to store the accumulated strip 224 per each cycle of chatter. The height of a work roll in a stand (e.g., the first stand 208) can be tightly regulated at low frequencies (e.g., well below third octave frequencies) and general tension can be controlled by other mechanisms, such as by controlling the difference in speed between a first stand and a second stand, as well as the gap of the first stand. At chatter frequencies, however, the average roll height (e.g., distance between the top work roll and bottom work roll) can deviate. The controller 220 can focus on controlling the disturbances in the frequency band corresponding to self-excited third octave vibration. To ensure that the controller 220 has sufficient range of action, tension disturbances outside this frequency range can be rejected from the signal used to drive the high-speed tension adjustor 204, such as using some combination of signal filtering.

As the metal strip 224 passes from the first stand 208 to the second stand 216, its tension can be adjusted to reject third octave vibration in the second stand 216. A controller 222 can receive signals, similar to controller 220, from one or more sensors, such as sensor 214 and sensor 218. Sensor 214 can be similar to sensor 206, but positioned between the first stand 208 and second stand 216. Sensor 218 can be similar to sensor 210, but positioned on the second stand 216. Other sensors can be used. Similarly to high-speed tension adjustor 204, high-speed tension adjustor 212 can be positioned between the first stand 208 and second stand 216 to control tension in the third octave range based on signals from controller 222. In some cases, however, controller 222 can send signals to the first stand 208 to control the roll gap in the first stand 208, thus effectively controlling the speed with which the strip 224 enters the inter-stand region, thus controlling the effective tension of the strip 224 in the inter-stand region. In some cases, controller 222 can send signals to any combination of one or more of the first stand 208 and high-speed tension adjustor 212. In some cases, the functions of controller 222 and controller 220 are performed by a single controller.

The high-speed tension adjustors 204, 212 can store and release lengths of strip 224 to maintain constant tension despite third octave vibration at the first stand 208 or second stand 216. The chatter frequency determines the amount of strip storage needed to prevent feedback due to fluctuating strip tension. For example, given a strip velocity as a function of time, $V_{strip}=A \sin 2\pi f_c t$, where $f_c$ is the chatter frequency in hertz and A is the amplitude of speed variation, then the maximum storage required is shown below in Equation 2.

$$StripStorage_{max} = \frac{A}{\pi f_c} \qquad \text{Equation 2}$$

Mills generally chatter in the neighborhood of 90-300 hertz, and more particularly in the neighborhood of 90-200 hertz or 90-150 Hz. Since the lower frequency requires more storage, this value (e.g., 90 Hz) can be used to calculate the largest amount of strip storage length that would be needed. Such a value can be used to set the strip storage length in a high-speed tension adjustor 204, 212. In contrast, higher frequencies must operate faster and thus the upper limit (e.g., 150 Hz, 200 Hz, or 300 Hz) can be used to calculate the fastest a high-speed tension adjustor 204, 212 would need to operate. Such a value can be useful when determining hydraulic flow rates, such as when hydraulic linear actuators are used, as hydraulic flow rates can be a limiting factor in high-speed adjustments.

Once the third octave frequency range is established, the value of 'A' needs to be defined to determine the maximum strip storage length. The value of A depends on the amount of gauge variation that is acceptable in a rolled strip. In an example, in some circumstances, if chatter causes a gauge variation of approximately 1%, the resultant damage can cause the strip to be rejected as scrap. Other percentages of gauge variation can be used, depending on the needs of the rolled strip and other factors. For the purposes of this example, the maximum entry strip speed variation will be 1%. For a two stand tandem mill rolling canned beverage stock (CBS) at 2000 meters per minute (MPM), the inter-stand speed can be no more than approximately 1000 MPM. The value of 'A' can then be 10 MPM (a gauge variation will cause a 1% change in velocity, conservation of mass flow through gap) or 0.16666 meters per second (MPS). The amount of storage required at 90 hertz for this example can therefore be approximately 0.60 mm, because $$StripStorage_{max} = \frac{0.16666 \text{ MPS}}{\pi * 90 \text{ Hz}} = 0.000589 \text{ M} = 0.58 \text{ mm}.$$

Therefore, in this example, a suitable high-speed tension adjustor 204 must be able to displace approximately 0.60 mm at a speed of 90 Hz.

The above calculations can be adjusted as necessary for other examples. The above calculations can also be leveraged by a controller in order to drive a high-speed tension adjustor as necessary.

Figure 3:
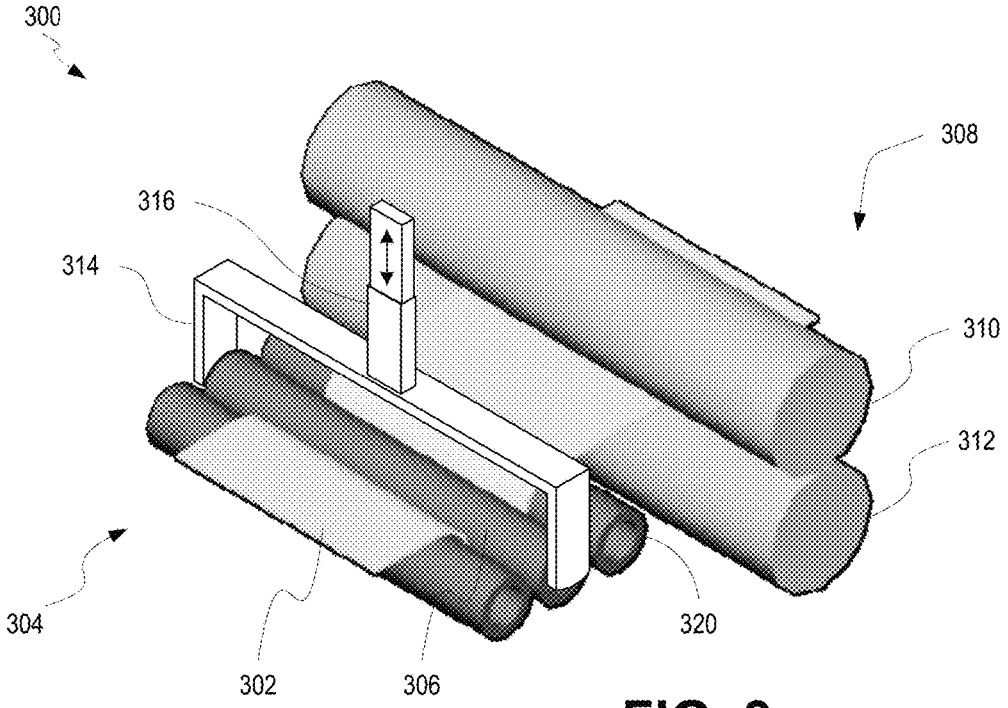
FIG. 3 is an isometric diagram depicting a third octave vibration control system with a yolk-controlled bridle according to certain aspects of the present disclosure.

FIG. 3 is an isometric diagram depicting a third octave vibration control system 300 with a yolk-controlled bridle 304 according to certain aspects of the present disclosure. A metal strip 302 passes through a bridle 304 and into a mill stand 308 having a top work roll 310 and a bottom work roll 312. The center roll 306 of the bridle 304 acts as a high-speed tension adjustor. As the center roll 306 is manipulated downwards and upwards, metal strip 302 is stored or released, respectively, from around a portion of the circumference of the center roll 306. The center roll 306 can be supported by a yolk 314. Upwards or downwards movement of the center roll 306 can be achieved by manipulation of a linear actuator 316 coupled to the yolk 314. In some cases, more than one linear actuator 316 can be coupled to the yolk 314. Any suitable linear actuator 316 can be used, such as a hydraulic cylinder and/or a piezoelectric actuator. The plunge depth of the center roll 306 can be adjustable via a movable stop on a main hydraulic cylinder. The one or more linear actuators 316 can adjust the movable stop of the main hydraulic cylinder, thus adjusting the plunge depth of the center roll 306.

The bridle's center roll 306 can thus alter the path of the metal strip 302 before it enters a stand 308. Changing the stiffness of this nesting mechanism (e.g., adjustments to the movable stop of the main hydraulic cylinder) at high frequencies (e.g., third octave vibrations) can mitigate any tension variation resulting from the downstream stand's gap movement.

In cases where a linear actuator manipulates the yolk 314 (e.g., manipulates the yolk 314 itself or adjusts the end stops of the yolk 314), no differential tilt control loop may be necessary because the yolk 314 movement can be constrained by a rack and pinion assembly that maintains the side-to-side elevation of the yolk 314.

Figure 4:
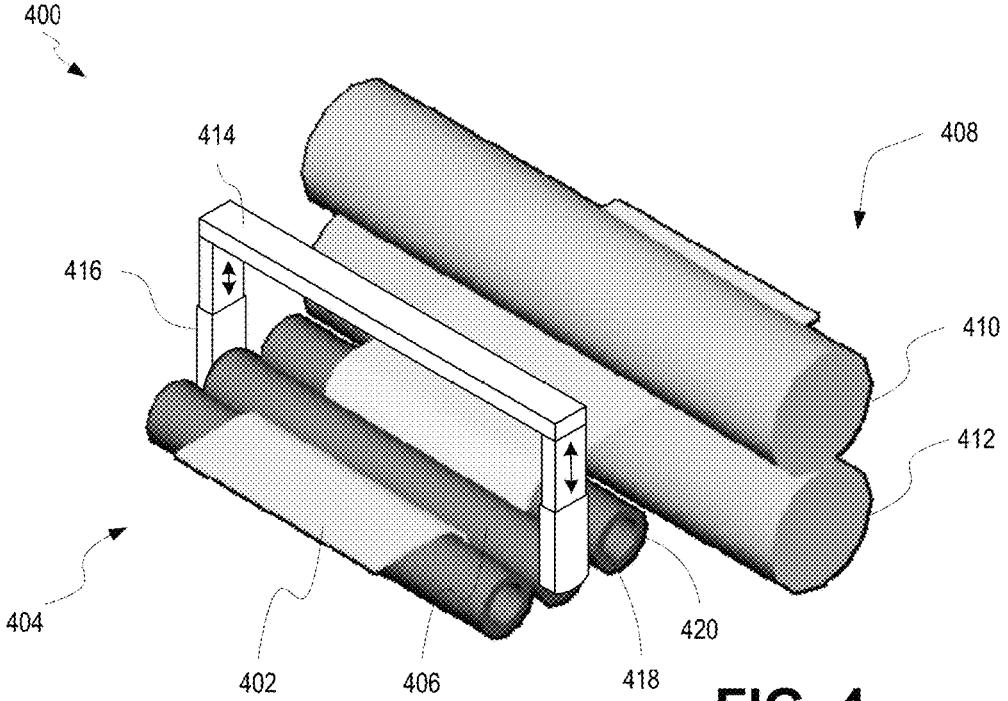
FIG. 4 is an isometric diagram depicting a third octave vibration control system with an end-controlled bridle according to certain aspects of the present disclosure.

FIG. 4 is an isometric diagram depicting a third octave vibration control system 400 with an end-controlled bridle 404 according to certain aspects of the present disclosure. A metal strip 402 passes through a bridle 404 and into a mill stand 408 having a top work roll 410 and a bottom work roll 412. The center roll 406 of the bridle 404 acts as a high-speed tension adjustor. As the center roll 406 is manipulated downwards and upwards, metal strip 402 is stored or released, respectively, from around a portion of the circumference of the center roll 406. The center roll 406 can be supported by a pair of linear actuators 416, 418. The pair of linear actuators 416, 418 can control the upwards and downwards movement of the center roll 406. Any suitable linear actuators 416, 418 can be used. For example, linear actuators 416, 418 can include hydraulic cylinders and/or piezoelectric actuators or any other suitable actuator.

In some cases, such end-mounted linear actuators 416, 418 can be used with a yolk 414, which can be actuated by another linear actuator. In such cases, the linear actuators 416, 418 allow the center roll 406 to move vertically separately from the nesting mechanism (e.g., yolk 414). Use of such end-mounted linear actuators 416, 418 removes the mass of the mechanism driving the center roll 406 (e.g., the yolk 414 and associated driving equipment) from the total mass necessary to be manipulated in order to control chatter. The use of end-mounted linear actuators 416, 418 can introduce the possibility of tilting the strip 406. In some cases, sensors and a control loop can be used to minimize, if not eliminate, tilt.

As described above with reference to FIGS. 3-4, center rolls 306, 406 can be manipulated using linear actuators 316, 416, 418. As described herein, other mechanisms, such as hydrofoils, can be used in place of center rolls 306, 406 to store strip length. Additionally, linear actuators 316, 416, 418 can be any combination of hydraulic, piezoelectric, or other linear actuators capable of producing sufficient linear actuation at sufficient speeds (e.g., from approximately 90 Hz to approximately 150 Hz, 200 Hz, or 300 Hz). While shown as generally rectangular in FIGS. 3-4, the linear actuators 316, 416, 418 can be cylindrical or other shaped.

In some cases, tension can be measured by means of load cells supporting the third bridle roll 320, 420 (closest to the mill bite). Tension can be measured by other sensors, as described elsewhere herein.

When a hydraulic linear actuator is used, the bore of the hydraulic linear actuator can be determined based on various factors, including maximum load necessary to maintain strip tension and minimized hydraulic fluid (e.g., oil) flow. In an example, a strip having a cross-sectional area of approximately 1600 $mm^2$, with a tension of approximately 20 $N/mm^2$ (20 MPa), with a geometry of 2:1 (e.g., center roll wrap angle of 180°—the amount of strip stored in the bridle for displacement of the work rolls), the maximum load needed to maintain strip tension can be $F_{cyl}$=2*20*1600=64 KN. To minimize hydraulic fluid flow, the supply pressure can be defined to be approximately 27.5 MPa. Allowing for a bore pressure of 14 $N/mm^2$, the cylinder area required can be $A_{cyl}$=64000/14=4600 $mm^2$. In this example, two hydraulic linear actuators can be located at each end of the roll to support the roll's vertical position (e.g., as seen in FIG. 4). The wrap angle on the first roll of the bridle is assumed to be approximately 90° as the strip's path goes from horizontal to vertical and passes under the center roll. Using a wrap angle of approximately 180° around the center roll of the bridle, the maximum vertical force can be approximately 64 KN. Again the maximum bore pressure can be half the supply pressure, yielding a cylinder area of 4600 $mm^2$. In this case however, the area is divided between two cylinders. The required bore size of each is approximately 54 mm. It can be desirable to round up to 60 mm (2827 $mm^2$) to provide an additional margin of safety. Similar calculations can be made for a single linear actuator 316 or for other circumstances (e.g., other sizes and types of metal sheet).

The stroke length of a hydraulic linear actuator can be determined based on various factors. Each cylinder stroke can be set to allow for the maximum storage per cycle. In an example, given a wrap angle of approximately 180° and a strip storage requirement of approximately 0.60 mm, the cylinder stroke can be reduced to approximately 0.30 mm. Adding some margin for error, a minimum stroke 2 mm can be used required.

The hydraulic linear actuator can be actuated by a servo-valve. In such cases, the servo-valve necessary for the hydraulic linear actuator can be determined based on various factors. For example, the servo-valve can be selected to be able to control the height of the center roll at 30 hertz (lower frequency tension disturbances are controlled by other actuators) while allowing the roll to move at the higher chatter frequencies. The worst case flow rate can be at the highest frequency of chatter (e.g., approximately 150 hertz or 200 Hz or 300 Hz). In some cases, the servo-valve can have the speed to hold the target strip tension as the length of strip between the stand and a preceding device (e.g., preceding stand or a decoiler) changes. In such an example, the change in length at the chatter frequency can be used as a guideline. Assuming an acceptable gauge variation of approximately 1% at 90 hertz, the target cylinder travel can be set at approximately 0.33 mm. Therefore, at 150 hertz, a flow rate of 48 lpm will be required ($Q_v$=2827 mm*0.30 mm*2π*150*60/1e6=48 lpm. The servo-valve required can be thusly selected. An example suitable servo-valve for a hydraulic-cylinder-based high-speed tension adjustor can be a Moog™ valve type D765 HR/38 lpm which can supply 40% (15.2 lpm) at a frequency of approximately 150 hertz. If the pressure drop is maintained at approximately 14 MPa, the flow rate is approximately 21.43 lpm. This design can use two valves on each hydraulic linear actuator to meet the flow requirements.

A high-speed tension adjustor can be controlled in various ways. In one example, the control strategy can be to create a position control loop around a fast tension loop. The position loop can set the average extension of the hydraulic actuator at half the hydraulic actuator's maximum extension (e.g., approximately 1 mm). The response of the position loop holding the hydraulic actuator's position fixed is approximately 30 hertz, which makes the hydraulic actuator very stiff up to approximately 30 hertz. The position controller supplies the pressure loop with a pressure reference. Therefore, the tension reference is a function of the load applied to the roll.

The inner tension loop can have a much higher response, such as approximately 150 hertz. Its purpose can be to allow the roll to move vertically as the applied load of the strip varies. As the tension varies due to load swings, the tension controller adds and subtracts small amounts of fluid to maintain the pressure reference supplied by the position controller.

When the linear actuator is a hydraulic linear actuator, the hydraulic components can be located below the strip 302, which can be advantageous for feeding the strip 302 during threading. When linear actuators 416, 418 are used, a tilt control loop (e.g., having the same response of the pressure loop) can be used to eliminate tilting of the roll as a source of error. In some cases, mechanical linkages may not be required, as the hydraulic actuator can act directly on the center roll's supporting shaft. In some cases, a close coupling between the hydraulic actuator and valve can be used to avoid lag. In some cases, a fast, real-time controller can be used for the tension loop. In some cases, the actuator can have a wide range of motion but may border on the edge of control with regard to frequency response capabilities of the selected actuator. In some cases, even if a servo is used that cannot sustain sufficient flow rate to allow for the full 150 hertz response to be achieved under certain conditions, there still may be a significant reduction in stiffness.

In some cases, one or more piezoelectric actuators can be used to adjust the height of a yolk 314 (e.g., a frame). Specifically, the piezoelectric actuator can be positioned to vary the height of the center bridle roll frame's adjustable end stop. The positioning of the end stop can set the plunge depth of the center roll 306. In some cases, a piezoelectric actuator capable of moving the frame can be located on top of each side's end stop assembly. The vertical movement of the center roll's frame (e.g., yolk 314) can be used to maintain a constant strip tension. In such cases, instead of moving the center roll 306 directly (e.g., as seen in FIG. 4), the piezoelectric actuators move the entire center roll 306 by moving the yolk 314. The piezoelectric actuators can be the same, but may require two or more units in parallel to handle the compression force supplied by the cylinder. In some cases, maintaining strip tension can require an actuator force equal to the applied tension force as well as the force needed to accelerate the frame vertically. For example, assuming that the weight of the roll assembly and frame is approximately 1500 Kgf and an acceleration rate of approximately 139 mm/sec$^2$ (180 μm @140 hertz), this acceleration force is approximately 21.3 KN.

In some case, the components can be mounted in a fixed position and located far away from the strip.

Figure 5:
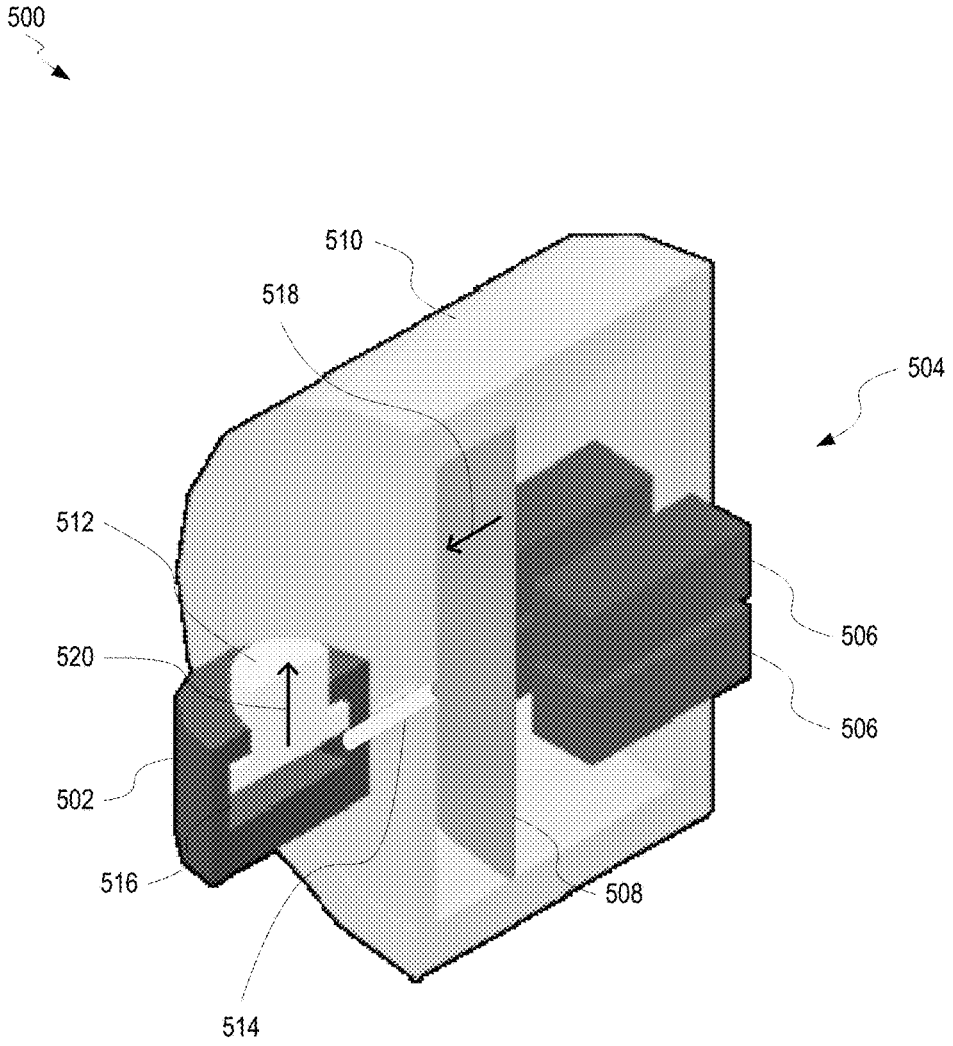
FIG. 5 is a partial-cutaway view of a linear actuator including a hydraulic actuator with a piezoelectric assist according to certain aspects of the present disclosure.

FIG. 5 is a partial-cutaway view of a linear actuator 500 including a hydraulic actuator 502 with a piezoelectric assist 504 according to certain aspects of the present disclosure. The linear actuator 500 can be used for any of the linear actuators disclosed herein, such as linear actuators 316, 416, 418 of FIGS. 3-4. The linear actuator 500 includes a hydraulic actuator 502 consisting of a main body supporting a piston 512 therein. The main body includes a driving cavity 516 into which hydraulic fluid can be circulated to manipulate the piston 512.

The piezoelectric assist 504 can include an assist body 510 coupled to the hydraulic actuator 502 by a channel 514. The assist body 510 can include one or more piezoelectric devices 506 coupled to a diaphragm 508. As an electrical current is applied to the one or more piezoelectric devices 506, each piezoelectric device 506 can deform to push the diaphragm 508 in direction 518. The diaphragm 508 can thus push hydraulic fluid into the driving cavity 516 through the channel 514, thus forcing the piston 512 in direction 520. Removing the electrical current or applying a reverse current can cause each piezoelectric device 506 to deform in an opposite direction, pulling on diaphragm 508, causing the piston 512 to move in a direction opposite of direction 520.

Because piezoelectric devices 506 can operate at very high frequencies, the piezoelectric assist 504 can increase the speed with which a hydraulic actuator 502 can function. A single hydraulic actuator 502 can include one or more piezoelectric assists 504.

In an example, with two hydraulic actuators positioned at the ends of a center roll (e.g., as seen in FIG. 4), each hydraulic actuator can be a hydraulic cylinder having a bore size of 60 mm with a minimum cylinder stroke of 2 mm. Similar to when no piezoelectric assist is used, the servo-valve must be able to control the height of the center roll at 30 hertz, while allowing the roll to move at the chatter frequency. However, unlike when no piezoelectric assist is used, in this example, this requirement is restricted to frequencies up to 30 hertz.

In this example, the change in length at the chatter frequency can be used as a guideline, with a gauge variation of 1% at 30 hertz giving a target strip storage of 1.76 mm. If the roll's wrap angle is approximately 180°, the vertical movement can be reduced to 0.88 mm. At 30 hertz, a flow rate of approximately 23 lpm is required (e.g., $Q_v$=2827 mm*0.88 mm*2π*30*60/1e6=28 lpm). In this example, a servo-valve can be selected capable of supplying the appropriate flow rate. For example, a Moog™ valve type D765 HR/38 lpm can supply 100% at a frequency of 30 hertz. In this example, the valve is not tasked with controlling the fluid flow at the chatter frequency. High frequency load variations can be left to the piezoelectric actuator.

The hydraulic actuator can be used to hold the average height of the center roll at a constant level at mid stroke of the hydraulic cylinder. Force variations at the chatter frequency will have no effect since the stiffness of the two cylinders combine to be much greater than the strip.

To accommodate high frequency tension disturbances, the piezoelectric actuator can be placed between the valve and the cylinder. The piezoelectric assist can change the volume of hydraulic fluid as a function of hydraulic fluid pressure. The length of the piezoelectric device changes as the pressure varies.

Since piezoelectric actuators change length by only approximately 0.1%, inserting such a device in line with the cylinder can be impractical. A 50 mm long piezoelectric will move approximately 0.05 mm. Instead, the piezoelectric device can be housed in a cylinder with a larger area. In an example, the cylinder housing the piezoelectric device can have an area of approximately 5 times the area of the hydraulic cylinder (e.g., 14,135 mm$^2$) capable of holding a number of piezoelectric devices (e.g., 50 mm long piezoelectric devices). In an example, by using a number of such piezoelectric devices having a surface area of approximately 15,000 sq. mm, to change the volume of oil by 706 mm$^3$, the resulting change in length on the working cylinder is approximately (706 mm$^3$/2827 mm$^2$), or 0.25 mm.

The linear actuator 500 with piezoelectric assist 504 can be controlled using any suitable strategy. In an example control strategy, a simple single degree of freedom position control loop is created. The position loop can set the average extension of the hydraulic cylinder at half the hydraulic cylinder's maximum extension (e.g., approximately 1 mm). The response of the position loop can be 30 hertz, which can make the cylinder very stiff up to 30 hertz.

While the position control loop indirectly drives the cylinder's average pressure to maintain a target extension, a separate controller can monitor the tension in the frequency range associated with chatter (e.g., third octave vibrations, such as 90-300 Hz). The separate controller can allow the roll to move vertically as the applied load of the strip varies. As the combined pressure of both hydraulic cylinders varies due to load swings, the controller can use the piezoelectric actuator(s) to change the total volume of oil in the assembly. In an example, this action can create a movement of 0.25 mm, which can be large enough to handle a change in entry strip speed.

In some cases, the use of a piezoelectric assist can eliminate any need for a fast, independent, tilt control loop. In some cases, there can be less dependency on the performance of the servo-valve since the frequency range of the piezoelectric device often exceeds a servo-valve's flow performance. In some cases, a hydraulic circuit may be used to maintain a pressure differential on the piezoelectric side of the diaphragm. In some cases, strip tension may be used as a feedback variable. Under certain conditions, fluid pressure alone could produce some error due to the acceleration force required to move the center roll.

Figure 6:
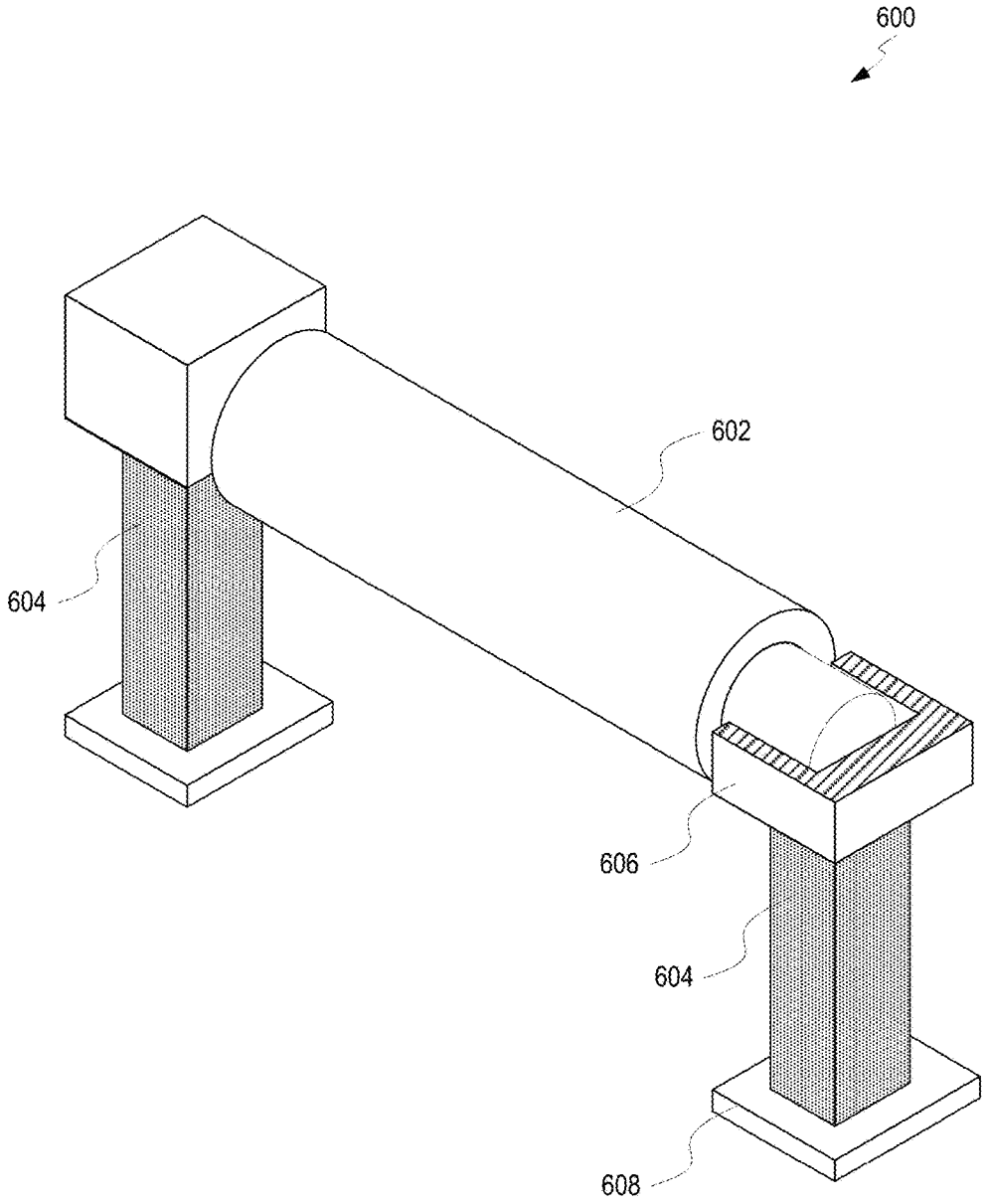
FIG. 6 is a partial cutaway, isometric view of a high-speed tension adjustor with piezoelectric actuators according to certain aspects of the present disclosure.

FIG. 6 is a partial cutaway, isometric view of a high-speed tension adjustor 600 with piezoelectric actuators 604 according to certain aspects of the present disclosure. A roll chock 606 can support a center roll 602 of a bridle. In some cases, a different deflecting device is used instead of a center roll 602, such as a hydroplane or wiper.

A piezoelectric actuator 604 can couple the roll chock 606 to a support 608. In some cases, the support 608 can be a yolk supporting the entire center roll 602. Electrical current applied to the piezoelectric actuator 604 can cause the piezoelectric actuator 604 to deform by extending or retracting, thus moving the center roll 602 upwards or downwards. As seen in FIG. 6, the center roll 602 can be supported by two piezoelectric actuators 604, one on each side. Each piezoelectric actuator 604 can include one or more individual piezoelectric devices mechanically arranged in parallel or series with one another to produce the desired movement in the center roll 602. The vertical movement of the center roll 602 is used to maintain a constant strip tension.

In some cases, a single piezoelectric device is capable of changing length by approximately 0.1% to 0.15% at full voltage and can generate a force in the range of 30 MPa per $mm^2$. For example, a commercially available standard piezoelectric stack having a diameter of approximately 56 mm and a length of approximately 154 mm can produce a blocking force of approximately 79 KN and a change in length of approximately 180 μm.

Maintaining strip tension can require an actuator force equal to the applied tension force, as well as the force needed to accelerate the center roll 602 vertically (e.g., which can be reduced by using a hydrofoil or other deflector having a smaller mass than a center roll 602). For example, assuming that the weight of the center roll 602 assembly is approximately 500 Kgf and an acceleration rate of approximately 139 $mm/sec^2$ (180 μm @140 hertz), this acceleration force is approximately 7.1 KN.

In some cases, the length of the piezoelectric actuator 604 is maximized to deliver the largest change in length available.

Controlling piezoelectric actuators 604 can be done in any suitable fashion. In one example, the control strategy includes creating a strip tension control loop. The total strip tension feedback is measured by sensors (e.g., load cells mounted at each end of an adjacent bridle roll, such as the roll closest to the work rolls). A controller can drive the piezoelectric actuators 604 to maintain the target strip tension. A differential control loop can maintain differential tension (side-to-side) as close to zero as possible.

In some cases, a controller with a fast execution rate (e.g., at or around 100 μsec or faster) can be used. A combination of a digital and analog control can be used. In some cases, a high current driver can be used. In some cases, piezoelectric devices can be selected that offer at least a 0.15% change in length.

The use of only piezoelectric actuators 604 in a high-speed tension adjustor can eliminate the need for many moving parts and hydraulic parts.

Figure 7:
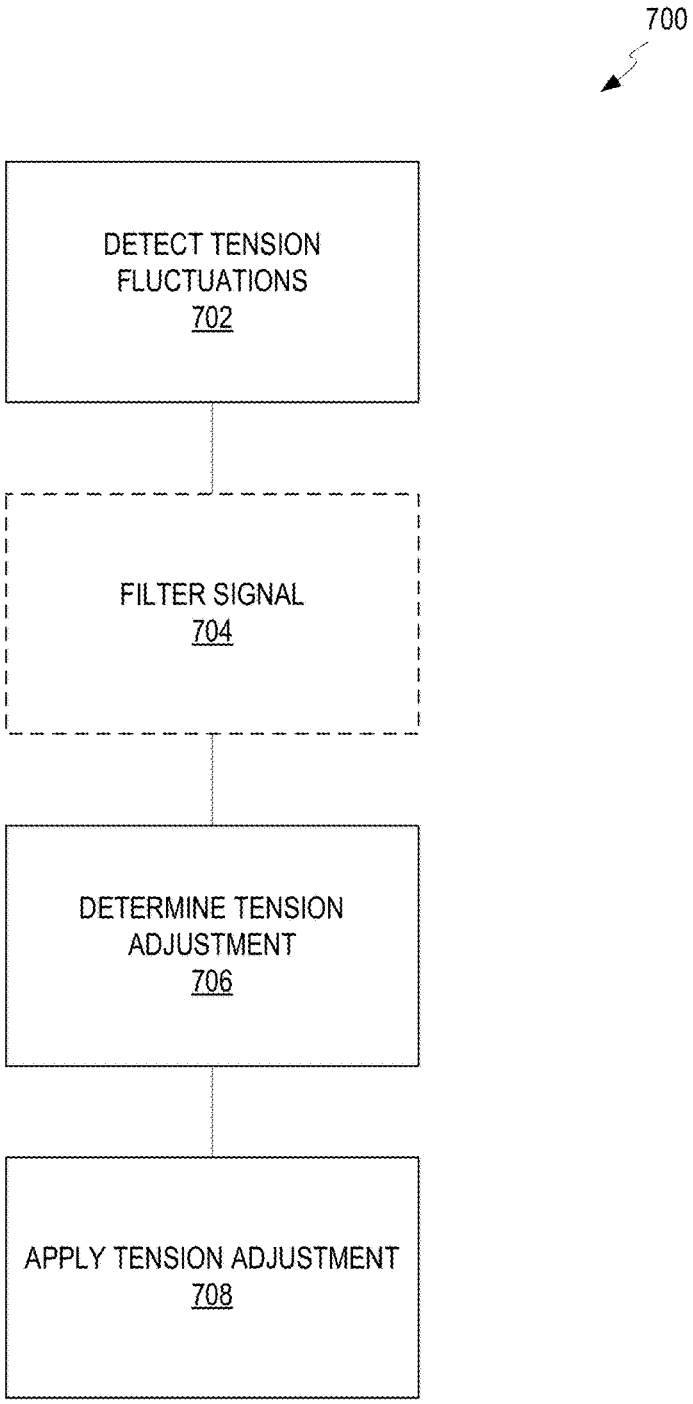
FIG. 7 is a flow chart depicting a process for controlling vibration in a mill according to certain aspects of the present disclosure.

FIG. 7 is a flow chart depicting a process 700 for controlling vibration in a mill according to certain aspects of the present disclosure. At block 702, tension fluctuations are detected. Tension fluctuations can be detected by any suitable sensor, such as sensors 152, 154, 156, 158 in FIG. 1; load cell 166 in FIG. 1; or any other suitable sensor. These detected tension fluctuations can be sent to a controller in the form of a measured fluctuations signal.

At optional block 704, the measured fluctuations signal can be filtered to remove any detected tension fluctuations outside of the third octave range (e.g., outside of the 90-300 Hz range, 90-200 Hz range, or 90-150 Hz range). In some cases, other ranges besides the third octave range can be used.

At block 706, the tension adjustment can be determined. The tension adjustment can be based on a simple feedback-control loop based on the measured fluctuations signal or the filtered signal. In some cases, the tension adjustment can be calculated to maximize the interference of the applied tension adjustment with the measured strip tension fluctuations. The resultant tension adjustment can be transmitted as a tension adjustment signal.

At block 708, the tension adjustment can be applied using the tension adjustment signal. The tension adjustment signal can be sent to drivers or directly to the linear actuators of a high-speed tension adjustor. The tension adjustments made by the high-speed tension adjustor(s) can help maintain constant strip tension and can reduce the third octave vibrations in a metal strip and/or in a mill stand.

The use of process 700 can inject tension disturbances to reduce self-excited vibration, such as in the third octave range. Process 700 can be performed using any of the various systems and assemblies described herein, including in FIGS. 1-6. Process 700 can be applied before a strip enters a mill stand or between mill stands. In some cases, the use of process 700 can allow mill stands to roll at a greater speed than without process 700. Additionally, without the worry of self-excited third octave vibrations, mills can operate longer and faster with less scrap (e.g., scrap due to self-excited third octave vibrations). Significant savings of time, money, and resources can be achieved using process 700.

Figure 8:
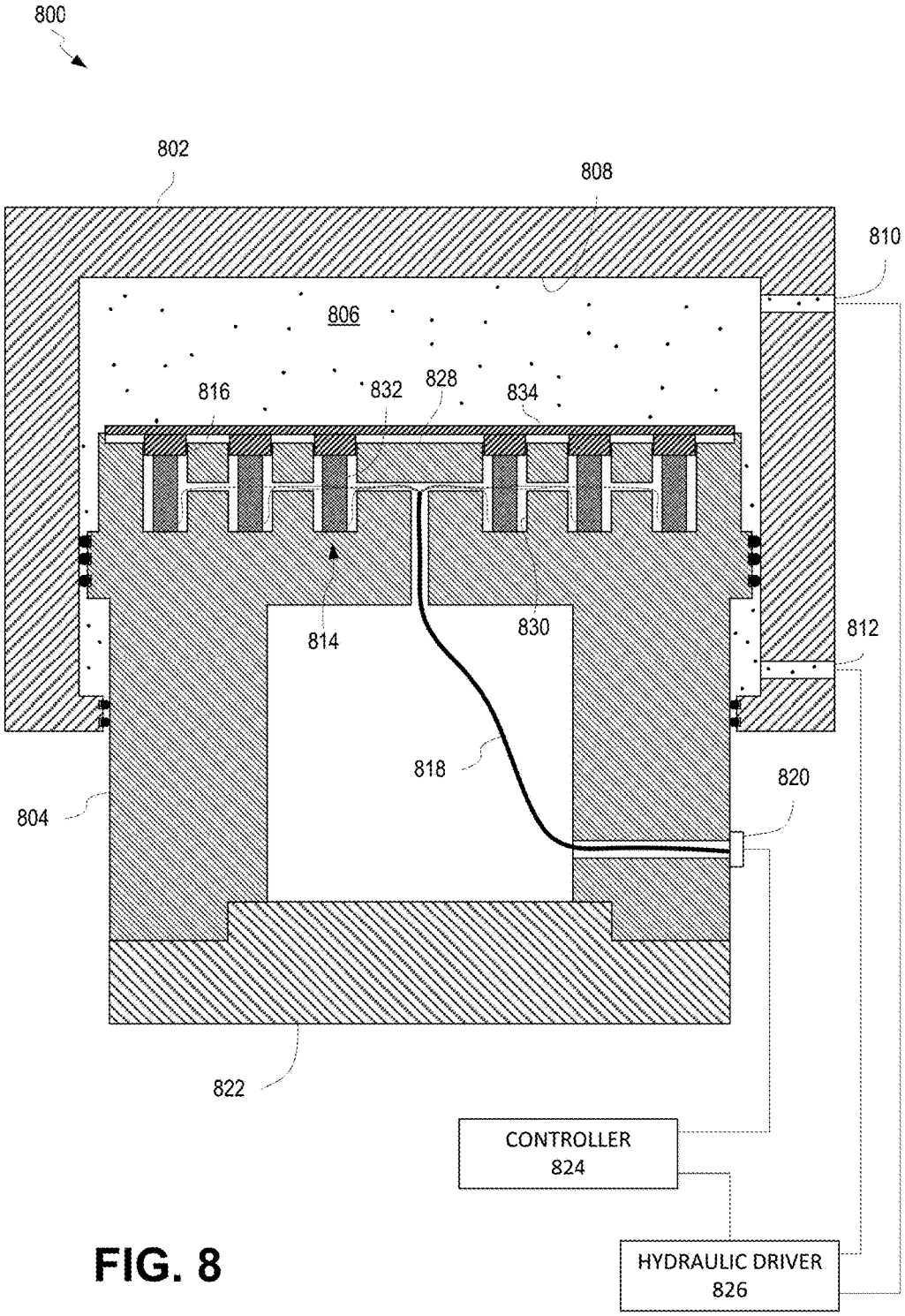
FIG. 8 is a cross-sectional view of a hydraulic actuator with piezoelectric assists in an extended state according to certain aspects of the present disclosure.

FIG. 8 is a cross-sectional view of a hydraulic actuator 800 with piezoelectric assists 814 in an extended state according to certain aspects of the present disclosure. The hydraulic actuator 800 can be any hydraulic actuator, such as those disclosed herein with reference to FIGS. 1, 3, and 4. The hydraulic actuator 800 can include a cylinder body 802 supporting a piston 804 therein. The cylinder body 802 includes a driving cavity 808 (e.g., fluid chamber) into which hydraulic fluid 806 can be circulated to manipulate the piston 804. Hydraulic fluid 806 can be circulated by a hydraulic driver 826 (e.g., servo-valves and/or other parts) controllable by controller 824 (e.g., such as controllers 220, 222 of FIG. 2). Hydraulic fluid 806 can be circulated through cylinder ports 810, 812 in order to raise or lower the piston 804.

The piston 804 can include a piston head 828 having one or more recesses 830. Piezoelectric assists 814 can be located within each recess 830. In some cases, multiple recesses 830 can be spread across the entire piston head 828 in order to maximize an amount of surface area actuatable by the piezoelectric assists 814. In alternate cases, piezoelectric assists can be located elsewhere besides the piston head as long as the piezoelectric assist is able to change the volume of the driving cavity 808.

As seen in FIG. 8, each piezoelectric assist 814 includes a piezoelectric device 832 (e.g., a piezoelectric stack) coupled to a sub-piston 816. The sub-piston 816 acts like a piston within the recess 830, moving axially to adjust the position of an end plate 834. Multiple sub-pistons 816 can act on a single end plate 834 in order to provide more actuation force. In some cases, no end plate 834 is used or multiple end plates 834 are used. Movement of the sub-pistons 816 can cause change in the volume of the driving cavity 808, such as through movement of an end plate 834.

As an electrical current is applied to a piezoelectric device 832, the piezoelectric device 832 can deform to either extend or retract, thus pushing or pulling on the sub-piston 816, which can then push or pull on the end plate 834. Opposite electrical current can be applied to deform the piezoelectric device 832 in the opposite direction. When the piezoelectric assists 815 are in an extended state, they have decreased the volume of the driving cavity 808.

Wiring 818 can couple each piezoelectric device 832 to controller 824 through a wiring port 820. Optionally, a piezoelectric driver can drive the piezoelectric devices 832 and the piezoelectric deriver can be controlled by the controller 824. An internal recess of the piston 804 can be covered by an end cap 822, which is coupled to the piston 804.

Because piezoelectric devices 832 can operate at very high frequencies, the piezoelectric assist 814 can increase the speed with which a hydraulic actuator 800 can function. A single hydraulic actuator 800 can include one or more piezoelectric assists 814.

To accommodate high frequency tension disturbances, the piezoelectric actuator can be placed between the valve and the cylinder. The piezoelectric assist can change the volume of hydraulic fluid as a function of hydraulic fluid pressure. The length of the piezoelectric device changes as the pressure varies.

Figure 9:
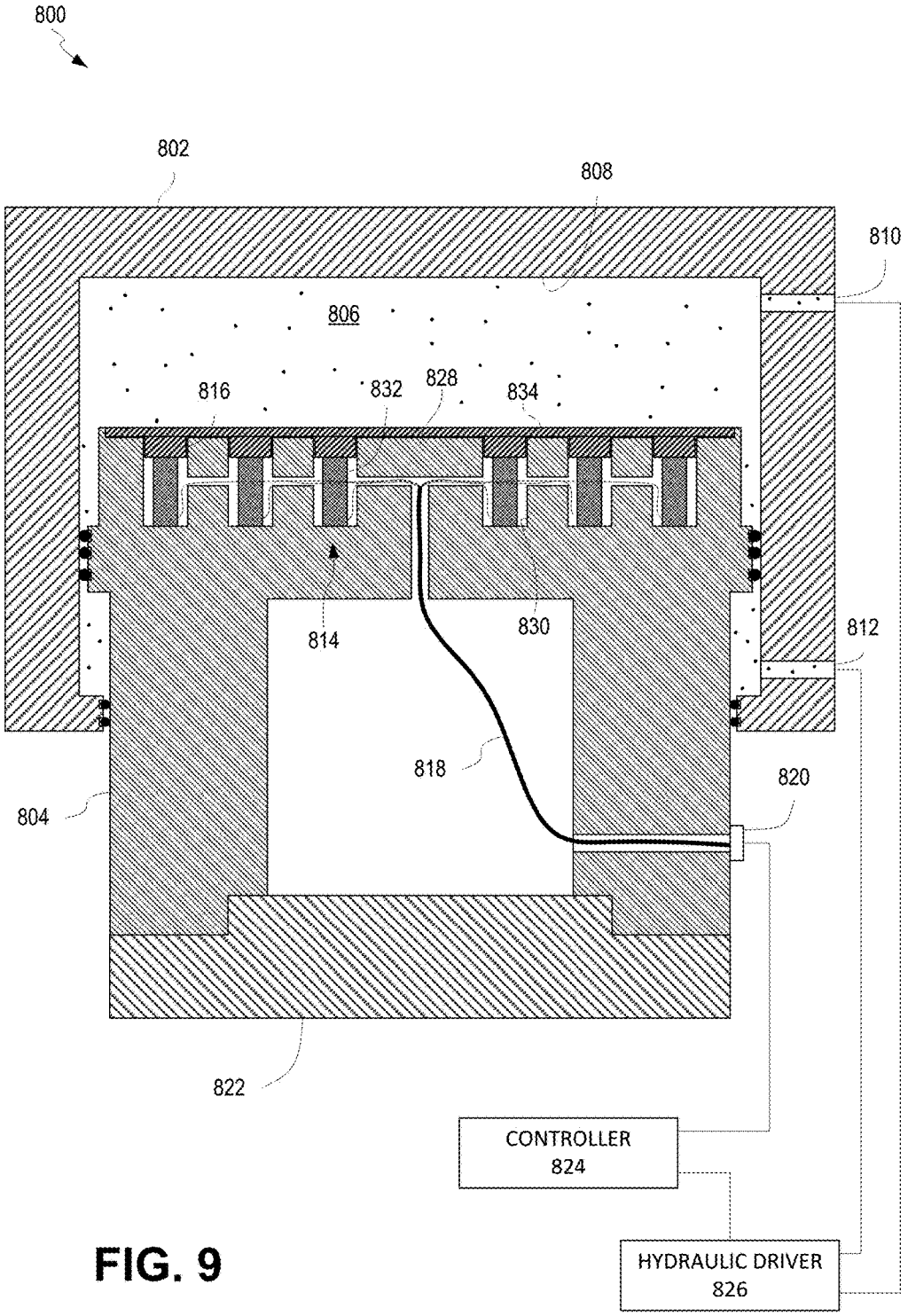
FIG. 9 is a cross-sectional view of the hydraulic actuator of FIG. 8 with piezoelectric assists in a retracted state according to certain aspects of the present disclosure.

FIG. 9 is a cross-sectional view of the hydraulic actuator 800 of FIG. 8 with piezoelectric assists 814 in a retracted state according to certain aspects of the present disclosure. Actuation of the piezoelectric devices 832 within the piezoelectric assists 814 can force the sub-pistons 816 to retract into the recesses 830 of the piston head 828, thus reducing the effective volume of the driving cavity 808. When an end plate 834 is used, retraction of the sub-pistons 816 cause retraction of the end plate 834, thus reducing the effective volume of the driving cavity 808.

When the sub-pistons 816 retract to reduce the effective volume of the driving cavity 808, the piston 804 and end cap 822 must move inwards with respect to the cylinder body 802 (e.g., upwards in FIGS. 8-9), especially when the hydraulic fluid 806 is incompressible. Hydraulic fluid 806 can be allowed to flow between the cylinder ports 810, 812 of the cylinder body 802. The controller 824 can continue to control the hydraulic driver 826 and can control the piezoelectric devices 832 via wiring 818 through the electrical port 820.

This small amounts of linear movement achieved through actuation of the piezoelectric assists 814, such as between an extended state (e.g., FIG. 8) and a retracted state (e.g., FIG. 9) can occur at extremely fast speeds (e.g., at or above approximately 90 hertz). Because the piezoelectric assists 814 are positioned between the hydraulic fluid 806 and the piston 804, movement of hydraulic fluid 806 is minimal in order to effectuate movement of the piston 804.

Different arrangements of the components depicted in the drawings or described above, as well as components and steps not shown or described are possible. Similarly, some features and sub-combinations are useful and may be employed without reference to other features and sub-combinations.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a two (or more) stand tandem cold mill comprising between stands: a tension adjustment device selected from the group consisting of a center bridle roll, an actuated deflection roll, or an actuated sheet wiper; and a control system designed to vary vertical placement of the tension adjustment device in response to inter-stand strip tension disturbances occurring at a frequency of third octave mill stand resonance typically in the range of approximately 90-300 hertz.

Example 2 is the mill of example 1, wherein the control system comprises at least two hydraulic cylinders located proximate each end of the tension adjustment device, and a controller having a position control loop and a fast tension loop, wherein the fast tension loop is configured to vary vertical placement of the tension adjustment device in response to tension disturbances occurring at the frequency of third octave mill stand resonance typically in the range of approximately 90-150 hertz, and the position control loop is configured to maintain the vertical placement of the tension adjustment device in response to tension disturbances occurring at lower frequencies.

Example 3 is the mill of example 1, wherein the control system comprises at least two hydraulic cylinders located proximate each end of the tension adjustment device, a plurality of piezoelectric actuators positioned between each of the at least two hydraulic cylinders and the tension adjustment device, and a controller having a position control loop and a separate controller, wherein the separate controller is configured to vary vertical placement of the tension adjustment device in response to tension disturbances occurring at the frequency of third octave mill stand resonance typically in the range of approximately 90-300 hertz, and the position control loop is configured to maintain the vertical placement of the tension adjustment device in response to tension disturbances occurring at lower frequencies.

Example 4 is the mill of example 3, wherein the frequency of third octave mill stand resonance is typically in the range of approximately 90-200 hertz.

Example 5 is the mill of example 1, wherein the control system comprises at least two piezoelectric stacks located proximate each end of the tension adjustment device, and a controller having a strip tension control loop configured to vary vertical placement of the tension adjustment device in response to tension disturbances occurring at the frequency of third octave mill stand resonance typically in the range of approximately 90-300 hertz.

Example 6 is the mill of example 5, wherein the frequency of third octave mill stand resonance is typically in the range of approximately 90-200 hertz.

Example 7 is the mill of example 1, wherein the control system comprises at least two piezoelectric stacks, each piezoelectric stack being located on an upper surface of an adjustable end stop on each side of a center frame supporting the tension adjustment device, and a controller having a strip tension control loop configured to vary vertical placement of the tension adjustment device in response to tension disturbances occurring at the frequency of third octave mill stand resonance typically in the range of approximately 90-300 hertz.

Example 8 is the mill of example 7, wherein the frequency of third octave mill stand resonance is typically in the range of approximately 90-200 hertz.

Example 9 is a single stand mill comprising: an uncoiler positioned upstream of the mill stand; a tension adjustment device selected from the group consisting of a center bridle roll, an actuated deflection roll, or an actuated sheet wiper; and a control system designed to vary vertical placement of the tension adjustment device in response to tension disturbances between the uncoiler and the mill stand.

Example 10 is the mill of example 9, wherein the control system comprises at least two hydraulic cylinders located proximate each end of the tension adjustment device, and a controller having a position control loop and a fast tension loop, wherein the fast tension loop is configured to vary vertical placement of the tension adjustment device in response to tension disturbances occurring at the frequency of third octave mill stand resonance typically in the range of approximately 90-150 hertz, and the position control loop is configured to maintain the vertical placement of the tension adjustment device in response to tension disturbances occurring at lower frequencies.

Example 11 is the mill of example 9, wherein the control system comprises at least two hydraulic cylinders located proximate each end of the tension adjustment device, a plurality of piezoelectric positioned between each of the at least two hydraulic cylinders and the tension adjustment device, and a controller having a position control loop and a separate controller, wherein the separate controller is configured to vary vertical placement of the tension adjustment device in response to tension disturbances occurring at the frequency of third octave mill stand resonance typically in the range of approximately 90-300 hertz, and the position control loop is configured to maintain the vertical placement of the tension adjustment device in response to tension disturbances occurring at lower frequencies.

Example 12 is the mill of example 11, wherein the frequency of third octave mill stand resonance is typically in the range of approximately 90-200 hertz.

Example 14 is the mill of example 9, wherein the control system comprises at least two piezoelectric stacks located proximate each end of the tension adjustment device, and a controller having a strip tension control loop configured to vary vertical placement of the tension adjustment device in response to tension disturbances occurring at the frequency of third octave mill stand resonance typically in the range of approximately 90-300 hertz.

Example 14 is the mill of example 13, wherein the frequency of third octave mill stand resonance is typically in the range of approximately 90-200 hertz.

Example 15 is the mill of example 9, wherein the control system comprises at least two piezoelectric stacks, each piezoelectric stack being located on an upper surface of an adjustable end stop on each side of a center frame supporting the tension adjustment device, and a controller having a strip tension control loop configured to vary vertical placement of the tension adjustment device in response to tension disturbances occurring at the frequency of third octave mill stand resonance typically in the range of approximately 90-300 hertz.

Example 16 is the mill of example 15, wherein the frequency of third octave mill stand resonance is typically in the range of approximately 90-200 hertz.

Example 17 is a system, comprising a tension adjustor positionable proximal an entrance of a mill stand for adjusting tension of a metal strip entering the mill stand; a sensor for measuring tension fluctuations at or above 90 hertz of the metal strip entering the mill stand; and a controller coupled to the sensor and the tension adjustor for actuating the tension adjustor to adjust the tension of the metal strip in response to the measured tension fluctuations.

Example 18 is the system of example 17, wherein the tension adjustor includes a deflection device capable of storing a length of the metal strip and at least one actuator for manipulating the deflection device to change the stored length of metal strip at speeds at or above approximately 90 hertz.

Example 19 is the system of example 18, wherein the deflection device is selected from the group consisting of a center roll of a bridle, a deflection roll, a sheet wiper, and a hydroplane.

Example 20 is the system of examples 18 or 19, wherein the at least one actuator is a pair of linear actuators positioned on opposite ends of the deflection device.

Example 21 is the system of examples 18 or 19, wherein the at least one actuator is coupled to the deflection device through a yolk.

Example 22 is the system of examples 18 or 19, wherein each of the at least one linear actuators is a piezoelectric actuator.

Example 23 is the system of examples 18 or 19, wherein each of the at least one linear actuators is a hydraulic actuator.

Example 24 is the system of example 23, wherein each of the at least one linear actuators further comprises a piezoelectric assist coupled to the hydraulic actuator.

Example 25 is the system of examples 17-24, wherein the sensor is coupled to the mill stand for detecting vibrations indicative of the tension fluctuations of the metal strip.

Example 26 is the system of examples 17-24, wherein the sensor is at least one load cell coupled to a roller positionable proximal the mill stand.

Example 27 is a cold-rolling mill, comprising a mill stand having a top work roll and a bottom work roll between which a metal strip can be passed; a tension adjustor positionable upstream of the mill stand for adjusting tension of the metal strip as the metal strip enters the mill stand; a sensor positionable on or adjacent the mill stand for detecting vibrations indicative of self-excited third octave vibration; and a controller coupled to the sensor and the tension adjustor to induce adjustment of the tension of the metal strip in response to detection of the vibrations indicative of self-excited third octave vibration.

Example 28 is the mill of example 27, wherein the tension adjustor is a preceding mill stand, and wherein the preceding mill stand adjusts the tension of the metal strip by adjusting the roll gap of the preceding mill stand.

Example 29 is the mill of example 27, wherein the tension adjustor comprises a deflection device capable of storing a length of the metal strip and at least one actuator for manipulating the deflection device to change the stored length of metal strip at speeds at or above approximately 90 hertz.

Example 30 is the mill of example 29, wherein the at least one actuator comprises a piezoelectric device.

Example 31 is a method, comprising rolling a metal strip on a mill stand, wherein the metal strip has an entry tension; detecting fluctuations in the entry tension at or above approximately 90 hertz; and adjusting the entry tension of the metal strip in response to the detected fluctuations.

Example 32 is the method of example 31, wherein adjusting the entry tension includes adjusting a roll gap of a preceding mill stand located upstream of the mill stand.

Example 33 is the method of example 31, further comprising storing a length of metal strip in a deflection device, wherein adjusting the entry tension includes adjusting the stored length of metal strip.

Example 34 is a method of examples 31-33, wherein adjusting the entry tension includes actuating a piezoelectric actuator.

Example 35 is the method of examples 31-34 further comprising filtering the detected fluctuations to exclude fluctuations below approximately 90 hertz and above approximately 300 hertz.

Example 35 is the method of examples 31-35, wherein detecting fluctuations the entry tension includes detecting changes in a roll gap of the mill stand.

What is claimed is:

1. A system, comprising:

a tension adjustor positionable upstream of an entrance of a mill stand for adjusting tension of a metal strip entering the mill stand at a rolling speed;

a sensor positionable on or adjacent the mill stand for measuring tension fluctuations at or above 90 hertz of the metal strip entering the mill stand; and a controller coupled to the sensor and the tension adjustor for actuating the tension adjustor to adjust the tension of the metal strip in response to the measured tension fluctuations while maintaining the rolling speed.

2. The system of claim 1, wherein the tension adjustor includes a deflection device capable of storing a length of the metal strip and at least one actuator for manipulating the deflection device to change the stored length of metal strip at frequencies at or above approximately 90 hertz.

3. The system of claim 2, wherein the deflection device is selected from the group consisting of a center roll of a bridle, a deflection roll, a sheet wiper, and a hydroplane.

4. The system of claim 2, wherein the at least one actuator is a pair of linear actuators positioned on opposite ends of the deflection device.

5. The system of claim 2, wherein the at least one actuator is coupled to the deflection device through a yoke.

6. The system of claim 2, wherein each of the at least one linear actuators is a piezoelectric actuator.

7. The system of claim 2, wherein each of the at least one linear actuators is a hydraulic actuator.

8. The system of claim 7, wherein each of the at least one linear actuators further comprises a piezoelectric assist coupled to the hydraulic actuator.

9. The system of claim 1, wherein the sensor is coupled to the mill stand for detecting vibrations indicative of the tension fluctuations of the metal strip.

10. The system of claim 1, wherein the sensor is at least one load cell coupled to a roller positionable upstream of the mill stand.

11. A cold-rolling mill, comprising:

a mill stand having a top work roll and a bottom work roll between which a metal strip can be passed at a rolling speed;

a tension adjustor positionable upstream of the mill stand for adjusting tension of the metal strip as the metal strip enters the mill stand;

a sensor positionable on or adjacent the mill stand for detecting vibrations indicative of self-excited third octave vibration; and a controller coupled to the sensor and the tension adjustor to induce adjustment of the tension of the metal strip in response to detection of the vibrations indicative of self-excited third octave vibration while maintaining the rolling speed.

12. The mill of claim 11, wherein the tension adjustor is a preceding mill stand, and wherein the preceding mill stand adjusts the tension of the metal strip by adjusting a roll gap of the preceding mill stand.

13. The mill of claim 11, wherein the tension adjustor comprises a deflection device capable of storing a length of the metal strip and at least one actuator for manipulating the deflection device to change the stored length of metal strip at speeds at or above approximately 90 hertz.

14. The mill of claim 13, wherein the at least one actuator comprises a piezoelectric device.

15. A method, comprising:

rolling a metal strip on a mill stand at a rolling speed, wherein the metal strip has an entry tension;

detecting fluctuations in the entry tension at or above approximately 90 hertz by a sensor positionable on or adjacent the mill stand; and adjusting the entry tension of the metal strip in response to the detected fluctuations by a tension adjustor positionable upstream of the mill stand while maintaining the rolling speed, wherein adjusting the entry tension comprises using a controller coupled to the sensor and the tension adjustor.

16. The method of claim 15, wherein adjusting the entry tension includes adjusting a roll gap of a preceding mill stand located upstream of the mill stand, wherein the tension adjustor includes the preceding mill stand.

17. The method of claim 15, further comprising storing a length of metal strip in a deflection device, wherein adjusting the entry tension includes adjusting the stored length of metal strip, and wherein the tension adjustor includes the deflection device.

18. The method of claim 17, wherein adjusting the entry tension includes actuating a piezoelectric actuator, wherein the tension adjustor includes the piezoelectric actuator.

19. The method of claim 15 further comprising filtering the detected fluctuations to exclude fluctuations below approximately 90 hertz and above approximately 300 hertz.

20. The method of claim 15, wherein detecting fluctuations in the entry tension includes detecting changes in a roll gap of the mill stand.

* * * * *